US008061151B2

(12) United States Patent
Telakowski et al.

(10) Patent No.: US 8,061,151 B2
(45) Date of Patent: Nov. 22, 2011

(54) REFRIGERANT COMPRESSOR

(75) Inventors: Robert Telakowski, Windsor Locks, CT (US); Darryl A. Colson, West Suffield, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 176 days.

(21) Appl. No.: 12/467,706

(22) Filed: May 18, 2009

(65) Prior Publication Data

US 2010/0287958 A1 Nov. 18, 2010

(51) Int. Cl.
*F25B 1/00* (2006.01)

(52) U.S. Cl. ..... 62/115; 62/510

(58) Field of Classification Search ..... 62/115, 62/505, 510, 324.6, 498, 508; 417/350, 423.8
See application file for complete search history.

(56) References Cited

U.S. PATENT DOCUMENTS

| | | | | |
|---|---|---|---|---|
| 3,554,676 | A | 1/1971 | Porteous | |
| 5,261,800 | A | 11/1993 | Sakae | |
| 6,064,121 | A | 5/2000 | Shervington et al. | |
| 6,254,365 | B1 | 7/2001 | Nakanishi | |
| 6,450,781 | B1 * | 9/2002 | Petrovich et al. | 417/350 |
| 6,631,617 | B1 * | 10/2003 | Dreiman et al. | 62/84 |
| 6,637,216 | B1 | 10/2003 | Narney, II | |
| 6,663,044 | B1 | 12/2003 | Munoz et al. | |
| 7,147,444 | B2 | 12/2006 | Cheon | |
| 7,213,405 | B2 * | 5/2007 | Shapiro | 62/228.3 |
| 7,240,515 | B2 * | 7/2007 | Conry | 62/510 |
| 7,334,422 | B2 | 2/2008 | Zywiak et al. | |
| 7,435,063 | B2 | 10/2008 | Tadano et al. | |
| 7,478,539 | B2 * | 1/2009 | Shapiro et al. | 62/175 |
| 7,614,251 | B2 * | 11/2009 | Choi et al. | 62/510 |
| 7,722,346 | B2 * | 5/2010 | Kishi et al. | 418/201.1 |
| 7,762,792 | B2 * | 7/2010 | Tadano et al. | 417/410.3 |
| 7,779,642 | B2 * | 8/2010 | Bae et al. | 62/175 |
| 2003/0126885 | A1 * | 7/2003 | Ebara et al. | 62/505 |
| 2003/0167784 | A1 * | 9/2003 | Higashiyama | 62/228.3 |
| 2008/0245097 | A1 * | 10/2008 | Cho et al. | 62/510 |
| 2009/0013714 | A1 * | 1/2009 | Yamaguchi et al. | 62/510 |

FOREIGN PATENT DOCUMENTS

| | | |
|---|---|---|
| EP | 1 880 940 | 1/2008 |

* cited by examiner

*Primary Examiner* — Mohammad Ali
(74) *Attorney, Agent, or Firm* — Cantor Colburn LLP

(57) ABSTRACT

Disclosed is a compressor (12) for a refrigeration system (10) including a housing (30) and at least one compressor impeller (24, 26) located in the housing (30) capable of compressing a refrigerant flow (14) through the compressor (12). At least one refrigerant pathway (44, 62) is located inboard of an outer surface (48) of the housing (30) and extends from a first compressor impeller (24). Further disclosed is a refrigeration system (10) including a compressor (12) having at least one refrigerant pathway (44, 62) located inboard of an outer surface (48) of the housing (36) and extending from a first compressor impeller (24) of at least one compressor impeller (24, 26). Further disclosed is a method of flowing refrigerant through a compressor (12).

15 Claims, 4 Drawing Sheets

REFRIGERANT COMPRESSOR

BACKGROUND OF THE INVENTION

The subject matter disclosed herein relates to compressors. More specifically, the subject disclosure relates to fluid flow in a compressor.

Compressors are utilized in many different applications, for example, in vapor cycle refrigeration systems. In a typical vapor cycle refrigeration system, a circulating refrigerant flows through four components: a compressor, a condenser, an expansion valve and an evaporator. The refrigerant, in a vapor state, is compressed and heated in the compressor, then is condensed into a liquid in the condenser by a heat sink. The liquid refrigerant then undergoes a rapid reduction in pressure when routed through the expansion valve. The rapid expansion causes an evaporation of at least a portion of the refrigerant resulting in a lowering of the temperature of the refrigerant. The liquid portion of the refrigerant is then evaporated in the evaporator and heat is absorbed from a fluid, typically air for example, flowing thru the evaporator. Compressor power is typically provided by an electric motor.

The compressor portion, powered by an electrical motor, typically includes one or more compressor impellers rotatably located about a rotor shaft in a compressor housing assembly. The refrigerant passes through the impellers in succession, increasing the pressure and the temperature of the refrigerant. In many compressors, impellers are located at opposing ends of the compressor to improve rotor dynamics conditions. To convey the refrigerant between the impellers, one or more conduits are provided external to the housing assembly and connected at one or more ports. The refrigerant passes through a first impeller and exits the housing through the one or more ports into a first end of the one or more conduits and reenters the housing via ports near a second impeller and passes through the second impeller. In some systems, during the flow along the one or more conduits, the refrigerant is passed through a heat exchanger to remove heat generated from the compression via the first impeller. Additionally, a motor stator portion is located between the first and second impeller and is subjected to the heat due to the inefficiency in converting electric power to mechanical power. To cool the stator, cooling jackets are often added around the exterior of the stator portion.

The porting and connections to external conduits introduce additional components to the system and add weight. Further, the connections introduce a potential source of leakage which negatively impacts the performance and efficiency of the compressor and the refrigeration system.

BRIEF DESCRIPTION OF THE INVENTION

According to one aspect of the invention, a compressor for a refrigeration system includes a housing and at least two compressor impellers capable of compressing a refrigerant flow through the compressor. At least one refrigerant pathway is located inboard of an outer surface of the housing and extends from a first impeller of at least one impeller.

According to another aspect of the invention, a refrigeration system includes a condenser, an expansion valve in fluid communication with the condenser and an evaporator in fluid communication with the expansion valve. The system further includes a compressor in fluid communication with the condenser and the evaporator. The compressor includes a housing and at least one compressor impeller located in the housing capable of compressing a refrigerant flow through the compressor. At least one refrigerant pathway is located inboard of an outer surface of the housing and extends from a first impeller of the at least one impeller.

According to yet another aspect of the invention, a method of flowing refrigerant through a compressor includes urging a refrigerant flow past a first compressor impeller of at one compressor impeller located in a compressor housing and urging the refrigerant flow through at least one refrigerant pathway extending from the first impeller. The at least one refrigerant pathway is located inboard of an outer surface of the compressor housing.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
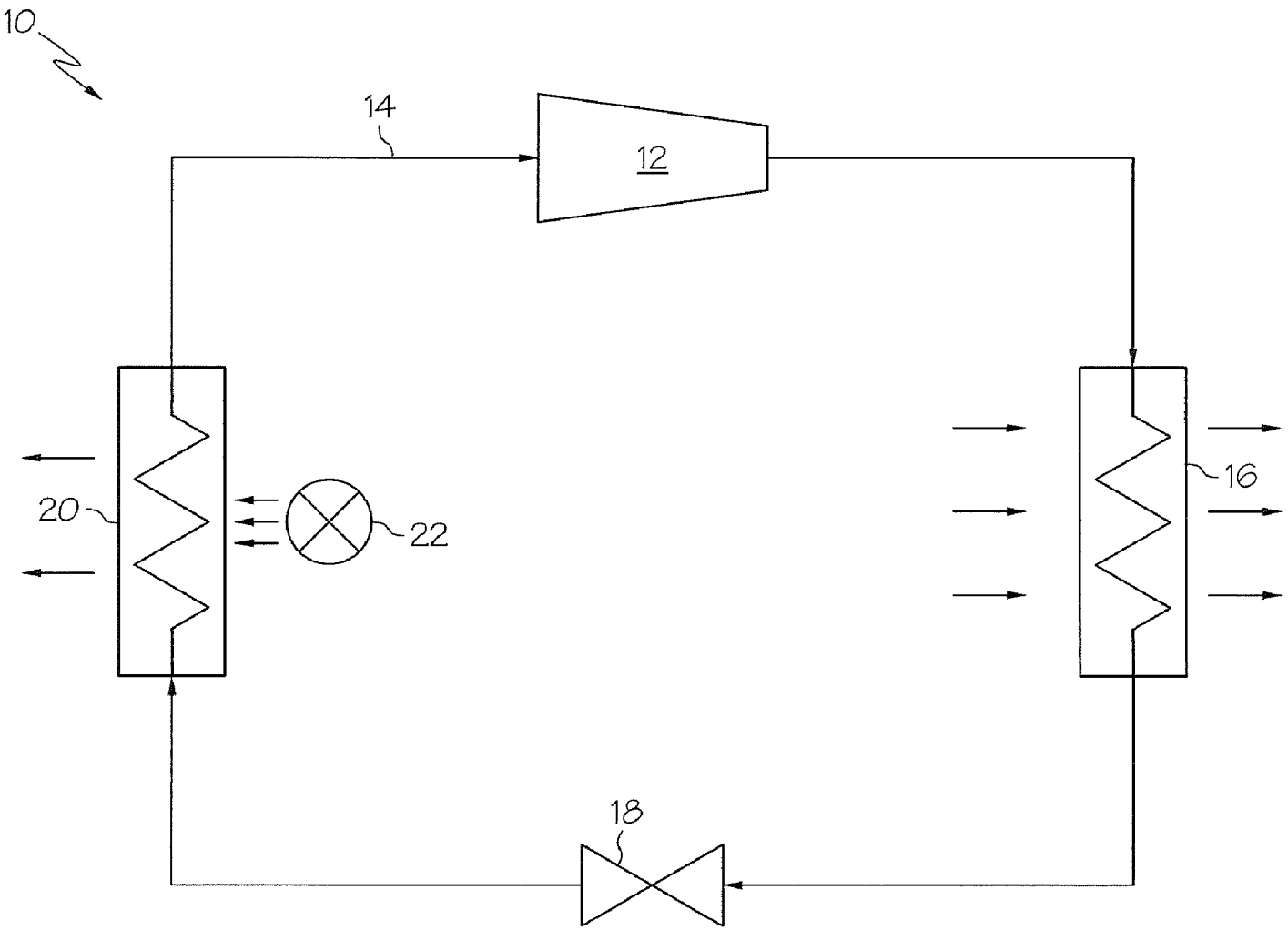
FIG. 1 is a schematic view of an embodiment of a vapor cycle refrigeration system.

Shown in FIG. 1 is schematic view of an embodiment of a vapor cycle refrigeration system 10. The system 10 includes a compressor 12 in which a circulating refrigerant flow 14 in a vapor state is compressed and heated. The refrigerant flow 14 is urged to a condenser 16 where the refrigerant flow 14 is condensed into a liquid state. The refrigerant flow 14 is rapidly depressurized in an expansion valve 18 which reduces the temperature of the refrigerant flow 14. The cooled refrigerant flow 14 is then routed to an evaporator 20 where it is evaporated and absorbs heat from a fluid flowing across the evaporator 20 by, for example, air as propelled by a fan 22.

Figure 2:
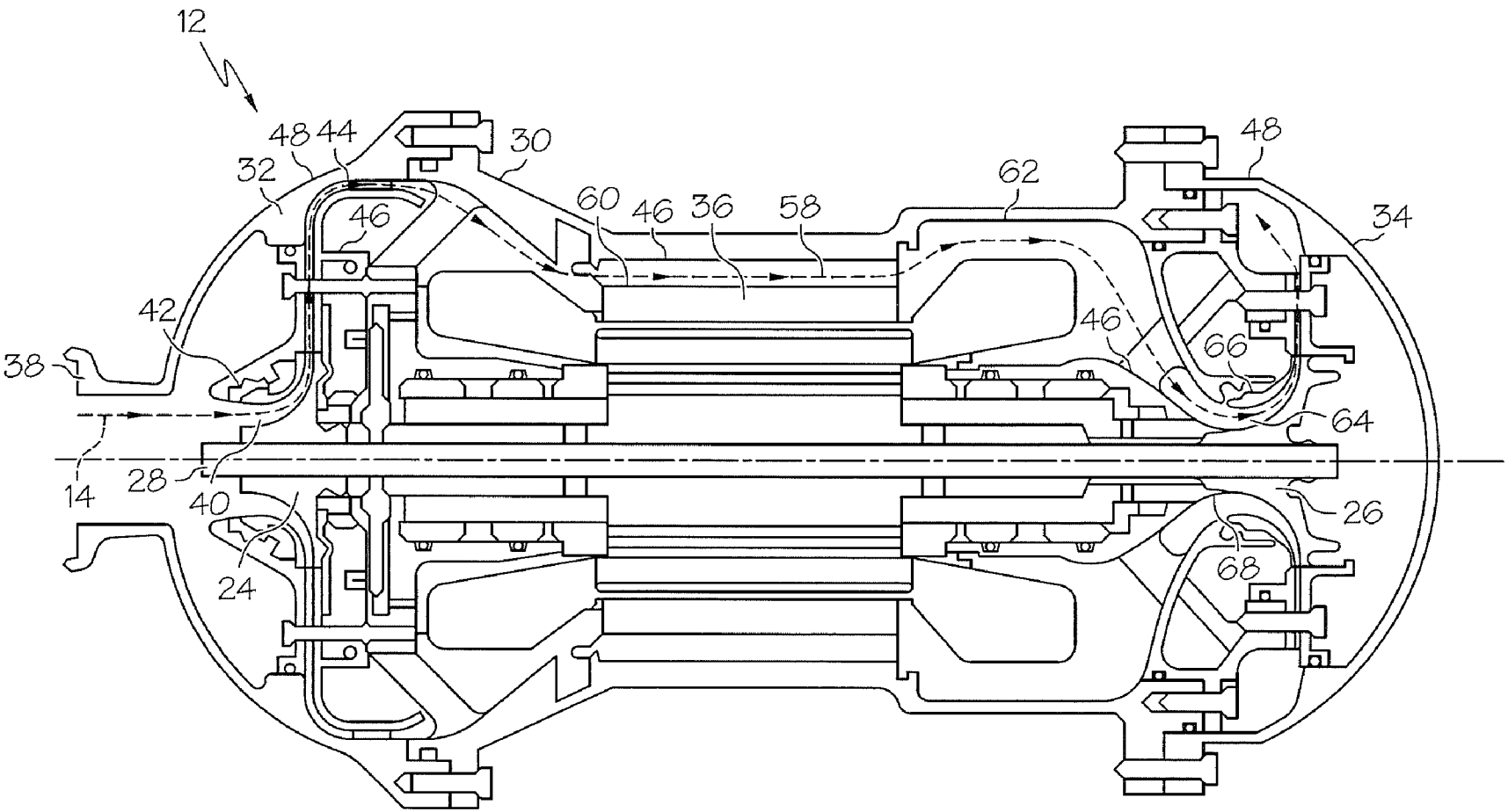
FIG. 2 is a cross-sectional view of an embodiment of a compressor.

FIG. 2 illustrates an embodiment of the compressor 12. The compressor 12 includes two compressor impellers, a first impeller 24 and a second impeller 26 axially secured to a shaft 28. In some embodiments, the first compressor impeller 24 and/or the second compressor impeller 26 are centrifugal rotors. In the embodiment of FIG. 2, the first compressor impeller 24 and the second compressor impeller 26 are disposed at substantially opposing ends of the shaft 28 for improved rotor dynamic characteristics. It is to be appreciated that other configurations, for example, ones where the first impeller 24 and second impeller 26 are disposed substantially adjacent on the shaft 28, are contemplated within the scope of the present disclosure. Further, while the quantity of compressor impellers illustrated in FIG. 2 is two, it is merely used as an example, and other quantities of compressor impellers, for example, 1, 3 or 4 or more compressor impellers, may be utilized. The compressor impellers 24 and 26 are disposed in a housing set 30, which in some embodiments comprises a first housing portion 32 and a second housing portion 34. In some embodiments, the first compressor impeller 24 is disposed in the first housing portion 32 and the second compressor impeller 26 is disposed in the second housing portion 34. Between the first compressor impeller 24 and the second compressor impeller 26, at least one motor stator section 36 is disposed in the housing 30.

The first housing portion 32 includes at least one input port 38 for input of the refrigerant flow 14 from the evaporator 20. The refrigerant flow 14 is urged to the first compressor impeller 24 by rotation of the first compressor impeller 24. The first compressor impeller 24 accelerates the refrigerant flow 14 through a first rotor channel 40 between the first compressor impeller 24 and a first housing member 42. The first rotor channel 40 gets progressively narrower along its length to increase the pressure of the refrigerant flow 14. The refrigerant flow 14 in some embodiments is urged substantially radially outwardly toward at least one first housing passage 44 disposed between an inner surface 46 and an outer surface 48 of the first housing portion 32. The at least one first housing passage 44 extends through the first housing portion 32 from the first rotor channel 40 to the motor stator section 36. The refrigerant flow 14 is urged therethrough toward the motor stator section 36.

Figure 3:
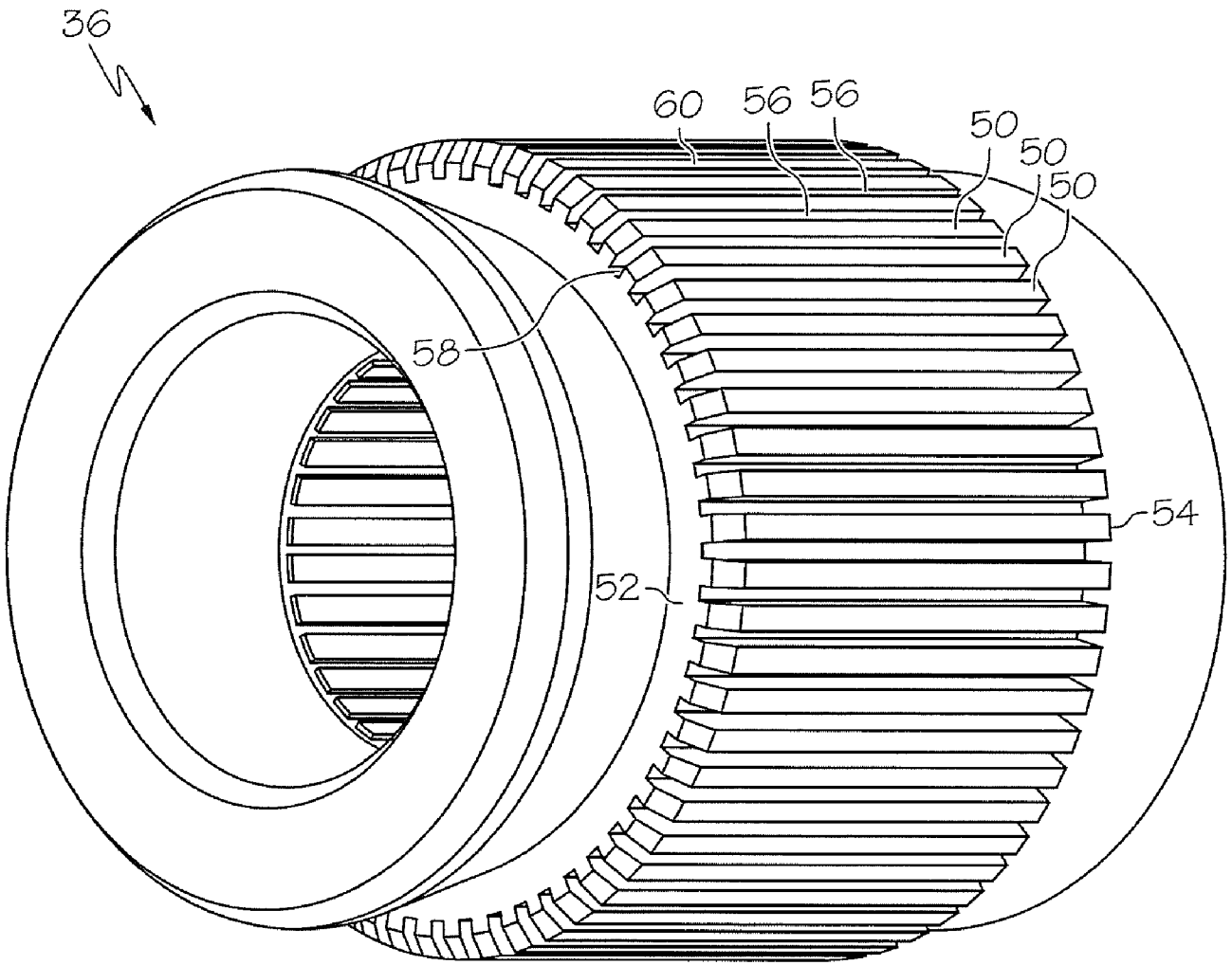
FIG. 3 is a perspective view of an embodiment of a stator section for a compressor.

Referring now to FIG. 3, the motor stator section 36 includes a plurality of motor stator members 50, extending substantially from a first motor stator end 52 to a second motor stator end 54 of the motor stator section 36. At least one stator slot 56 is disposed between adjacent motor stator members 50 of the plurality of motor stator members 50. A plurality of stator passages 58 are formed between the at least one stator slot 56, at an outer surface 60 of the motor stator section 36 and the inner surface 46 of the housing 30. The plurality of stator passages 58 are disposed and configured to be in connected to the at least one first housing passage 44 so that the refrigerant flow 14 is urged from the at least one first housing passage 44 through the plurality of stator passages 58 from the first motor stator end 52 to the second motor stator end 54 of the motor stator section 36 toward the second housing section 34. Flowing the refrigerant flow 14 through the plurality of stator passages 58 provides cooling to the motor stator section 36 so that, in some embodiments, additional cooling of the motor stator section 36 via, for example, cooling jackets, is not needed.

Figure 4:
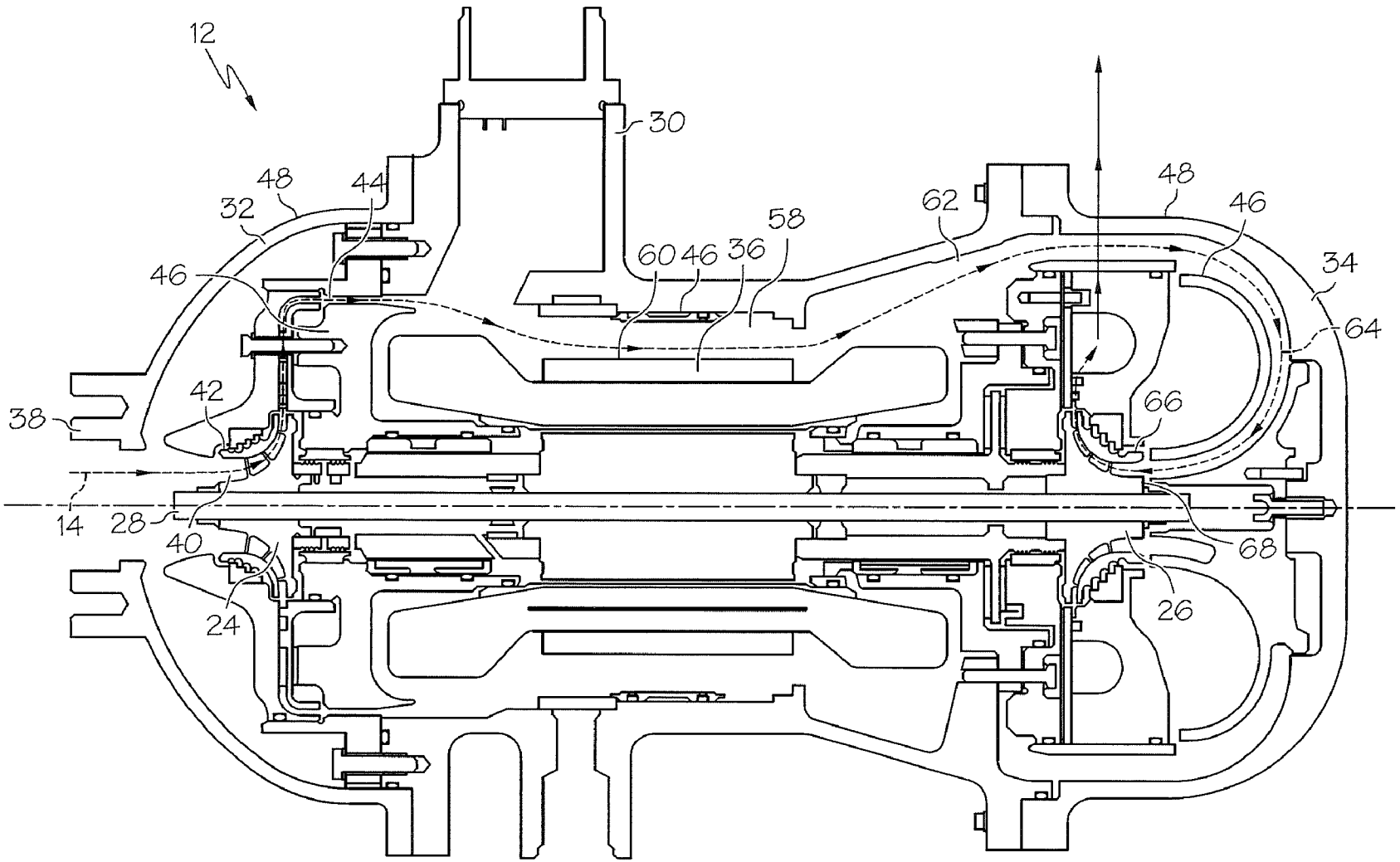
FIG. 4 is a cross-sectional view of another embodiment of a compressor.

Referring again to FIG. 2, the second housing section 34 includes at least one second housing passage 62. The at least one second housing passage 62 is disposed internal to the second housing section 34 between the inner surface 46 and the outer surface 48 of the second housing section 34, and is configured such that the refrigerant flow 14 is urged from the plurality of stator passages 58 into the at least one second housing passage 62. The refrigerant flow 14 flows through the at least one second housing passage 62 toward the second compressor impeller 26. The second compressor impeller 26 accelerates the refrigerant flow 14 through a second rotor channel 64 between the second compressor impeller 26 and a second housing member 66. The second rotor channel 64 gets progressively narrower along its length to increase the pressure of the refrigerant flow 14. In some embodiments, after being urged past the second compressor impeller 26, the refrigerant flow 14 exits the compressor 12 and flows toward the condenser 16. It is to be appreciated, however, that in other embodiments in which the compressor 12 comprises additional compressor impellers, the flow of refrigerant 14 continues to subsequent impellers in the compressor 12 in a substantially similar manner to that described above. As shown in FIG. 2, in some embodiments the second housing passage 62 carries the refrigerant flow 14 to be urged past the second compressor impeller 26 at a first side 68 of the second compressor impeller 26 disposed closest to the first compressor impeller 24. In other embodiments as, for example, shown in FIG. 4, the second compressor impeller 26 is disposed such that the first side 68 is disposed farthest from the first compressor impeller 24. In this embodiment, the second housing passage 62 is configured and disposed such that the refrigerant flow 14 flows past the second compressor impeller 26 beginning at the first side 68, located farthest from the first compressor impeller 24.

Flowing the refrigerant flow 14 internally through the compressor 12 from compressor impeller to compressor impeller, as opposed to externally, eliminates external hardware and connectors which provide opportunities for leakage of the refrigerant flow 14 from the compressor 12. Further, elimination of parts reduces weight of the compressor 12. A direct means of cooling the motor stator section 36 is provided, and heat from the motor stator section 36 eliminates liquid-state refrigerant from the refrigerant flow 14, so that the entire flow through the compressor 12 is in a vapor state. The entirely vapor state improves operational efficiency of any subsequent compressor rotors and of fluid film bearings which are utilized in some embodiments to support the rotating elements.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A compressor for a refrigeration system comprising:

a housing;

at least two compressor impellers disposed in the housing capable of compressing a refrigerant flow through the compressor; and at least one refrigerant pathway disposed inboard of an outer surface of the housing, the refrigerant pathway extending from a first compressor impeller of the at least one compressor impeller and configured to convey the refrigerant flow from the first compressor impeller to the second compressor impeller, without the refrigerant flow leaving the housing, the refrigerant flow conveyed from the first compressor impeller to the second compressor impeller via the at least one refrigerant pathway extending through at least one stator passage defined by an outer surface of the motor stator section and an inner surface of the housing.

2. The compressor of claim 1 wherein at least one motor stator section is disposed in the housing.

3. The compressor of claim 1 wherein the at least one refrigerant pathway is capable of cooling the motor stator section.

4. The compressor of claim 2 wherein the at least one motor stator section is disposed between the first compressor impeller and the second compressor impeller.

5. The compressor of claim 1 wherein at least a portion of the at least one refrigerant pathway is disposed between the outer surface of the housing and an inner surface of the housing.

6. The compressor of claim 1 wherein the at least two compressor impellers are centrifugal rotors.

7. A refrigeration system comprising:

a condenser;

an expansion valve in fluid communication with the condenser;

an evaporator in fluid communication with the expansion valve; and a compressor in fluid communication with the condenser and the evaporator, the compressor including:

a housing;

at least two-compressor impellers disposed in the housing capable of compressing a refrigerant flow through the compressor; and at least one refrigerant pathway disposed inboard of an outer surface of the housing, the refrigerant pathway extending from a first compressor impeller and configured to convey the refrigerant flow from the first compressor impeller to the second compressor impeller, without the refrigerant flow leaving the housing, the refrigerant flow conveyed from the first compressor impeller to the second compressor impeller via the at least one refrigerant pathway extending through at least one stator passage defined by an outer surface of the motor stator section and an inner surface of the housing.

8. The refrigeration system of claim 7 wherein at least one motor stator section is disposed in the housing.

9. The refrigeration system of claim 7 wherein the at least one refrigerant pathway is capable of cooling the motor stator section.

10. The refrigeration system of claim 8 wherein the at least one motor stator section is disposed between the first compressor impeller and the second compressor impeller.

11. The refrigeration system of claim 7 wherein at least a portion of the at least one refrigerant pathway is disposed between the outer surface of the housing and an inner surface of the housing.

12. The refrigeration system of claim 7 wherein the at least two compressor impellers are centrifugal rotors.

13. A method of flowing refrigerant through a compressor comprising:

urging a refrigerant flow past a first compressor impeller disposed in a compressor housing;

urging the refrigerant flow from the first compressor impeller through at least one refrigerant pathway extending from the first compressor impeller to a second compressor impeller, the at least one refrigerant pathway disposed inboard of an outer surface of the compressor housing and configured to convey the refrigerant flow from the first compressor impeller to the second compressor impeller without the refrigerant flow leaving the housing; and urging the refrigerant flow through at least one stator passage after urging the refrigerant flow past the first compressor impeller and before urging the refrigerant flow toward the second compressor impeller, the at least one stator passage defined by an outer surface of a motor stator section disposed in the compressor housing and an inner surface of the compressor housing.

14. The method of claim 13 comprising urging the refrigerant flow from the at least one refrigerant pathway past the second compressor impeller.

15. The method of claim 13 comprising cooling the motor stator section via the refrigerant flow through the at least one stator passage.

* * * * *